US006539924B2

(12) United States Patent
Ricco

(10) Patent No.: US 6,539,924 B2
(45) Date of Patent: Apr. 1, 2003

(54) INTERNAL COMBUSTION ENGINE FUEL INJECTOR, AND RELATIVE METHOD OF CLASSIFYING AND SELECTING A SERIES OF INJECTORS

(75) Inventor: Mario Ricco, Casamassima (IT)

(73) Assignee: C.F.R. Societa Consortile per Azioni (IT)

( * ) Notice: Subject to any disclaimer, the term of this patent is extended or adjusted under 35 U.S.C. 154(b) by 0 days.

(21) Appl. No.: 09/814,240

(22) Filed: Mar. 21, 2001

(65) Prior Publication Data

US 2001/0054414 A1 Dec. 27, 2001

(30) Foreign Application Priority Data

Mar. 21, 2000 (IT) ..... TO20A0267

(51) Int. Cl.[7] ..... F02M 51/00
(52) U.S. Cl. ..... 123/490; 123/472
(58) Field of Search ..... 123/490, 472; 239/585.1, 585.5, 5, 96, 533.3, 533.8; 251/43, 129.09, 320, 321

(56) References Cited

U.S. PATENT DOCUMENTS 4,669,429 A * 6/1987 Nishida et al. ..... 123/179.17
5,577,667 A * 11/1996 Gansser ..... 239/533.8
5,651,503 A * 7/1997 Ricco ..... 239/533.4
5,709,194 A 1/1998 Moncelle ..... 123/446

FOREIGN PATENT DOCUMENTS

DE 197 26 100 A1 1/1998 ..... F02D/41/34
DE 198 23 937 A1 12/1999 ..... F02M/47/02

* cited by examiner

*Primary Examiner*—Willis R. Wolfe
*Assistant Examiner*—Mahmoud Gimie
(74) *Attorney, Agent, or Firm*—Pennie & Edmonds LLP

(57) ABSTRACT

The injector has a nozzle closed by a rod which is movable by the fuel pressure in a control chamber having a discharge conduit closed by a plug controlled by an electromagnet. The rod is movable, from a closed position closing the nozzle, to effect a maximum travel, so that the amount of fuel injected following the maximum travel is greater than a maximum amount of fuel required by the power curve. To classify the injectors, a series of injectors is prepared with corresponding rods movable from the closed position to effect the maximum travel; and the amount of fuel injected by each injector, after two strokes of the respective rod smaller than the maximum travel, is tested.

8 Claims, 5 Drawing Sheets

INTERNAL COMBUSTION ENGINE FUEL INJECTOR, AND RELATIVE METHOD OF CLASSIFYING AND SELECTING A SERIES OF INJECTORS

The present invention relates to an internal combustion engine fuel injector, and to a relative method of classifying and selecting a series of injectors.

BACKGROUND OF THE INVENTION

Known fuel injectors generally comprise a nozzle normally closed by a rod which is caused to slide inside a cylindrical guide by the fuel pressure in a control chamber having a calibrated fuel intake conduit and a calibrated discharge conduit for discharging the chamber.

The discharge conduit is controlled by a metering valve in turn controlled by an electromagnet; and the length of time the electromagnet is energized varies according to the amount of fuel to be injected to achieve a given power of the engine. Depending on engine speed, the maximum power obtainable varies according to the so-called "power curve" of the engine.

The pressurized fuel for injection is fed along a feed conduit to an injection chamber located at a pin cooperating with the rod and engaging the injection orifices in the nozzle; and the injection chamber and feed conduit are normally sized to ensure the maximum amount of fuel is injected as quickly as possible.

When the electromagnet is energized, the metering valve is opened to move the rod into a stop position.

More specifically, in known so-called "hydraulic stop" injectors, the rod is arrested, dynamically balanced, a given distance from an end wall of the cylindrical rod guide, after a travel or lift which is roughly 0.2–0.25 mm for unit displacement engines up to 0.65 liters/cylinder, and up to 0.4 mm for higher displacement engines.

The behaviour of an injector of the above type is normally represented by a characteristic defining the amount of fuel injected as a function of the length of time the electromagnet is energized, and which is typically defined by a broken line comprising two substantially straight portions sloping at different angles. More specifically, the second portion slopes at a smaller angle than the first, and the two portions form a so-called "knee" at the point at which the rod, as it moves towards the stop position, is arrested in dynamic equilibrium.

Since mass produced injectors perform differently, the individual injectors fitted to a given engine must be tested and classified according to the delay (offset) between the start of injection and the instant the electromagnet is energized, and according to behaviour during injection, to define the amount of fuel injected alongside variations in the length of time the injector is opened. To reduce the difference in the amount of fuel injected into the engine cylinders by the respective injectors, each engine is fitted with injectors of the same class.

Known injectors have several drawbacks. In particular, the varying increase in the amount of fuel injected is accompanied by inconsistent behaviour of the injector, which varies widely from one injector to another and depends on the various conduit machining tolerances and mechanical connections. Classifying injectors is therefore a painstaking or random business, also on account of the hydraulic disturbance caused by arrest of the rod and the consequent reduction in the increase in the amount of fuel injected.

SUMMARY OF THE INVENTION

It is an object of the present invention to provide a fuel injector of the above type, which is extremely straightforward and reliable, and can be classified and selected accurately for assembly to a given engine, so as to eliminate the aforementioned drawbacks typically associated with known injectors.

According to the present invention, there is provided a fuel injector for an internal combustion engine having a predetermined power curve; the injector comprising a nozzle normally closed by a rod; said rod being movable, from a closed position closing said nozzle and through an opening stroke and a closing stroke, by the fuel pressure in a control chamber; said control chamber having an intake conduit and a discharge conduit; a metering valve, comprising a plug for said discharge conduit, being controlled by energizing an electromagnet for a variable length of time corresponding to the amount of fuel for injection; and the injector being characterized in that said rod is movable from said closed position to a position corresponding to a maximum travel, when said electromagnet is energized for a corresponding maximum time interval, so that the amount of fuel injected, between the start of said opening stroke into said position corresponding to said maximum travel, and the end of the respective closing stroke, is greater than a maximum amount of fuel required by said power curve.

The method of classifying and selecting a series of fuel injectors according to the invention is characterized by comprising the steps of:

preparing a series of injectors with corresponding rods; each of said rods being movable from a closed position and through an opening stroke to a position corresponding to a maximum travel, so that the amount of fuel injected, between the start of said opening stroke into said position corresponding to said maximum travel, and the end of the respective closing stroke, is greater than a maximum amount of fuel required by a power curve;

testing the amount of fuel injected by each of said injectors, by moving the corresponding rod into two positions at distances, from said closed position, smaller than said maximum travel, so as to define the delay in the start of injection and the increase in the amount of fuel injected; and selecting for a given engine a group of injectors having a given delay and a given increase in the amount of fuel injected.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
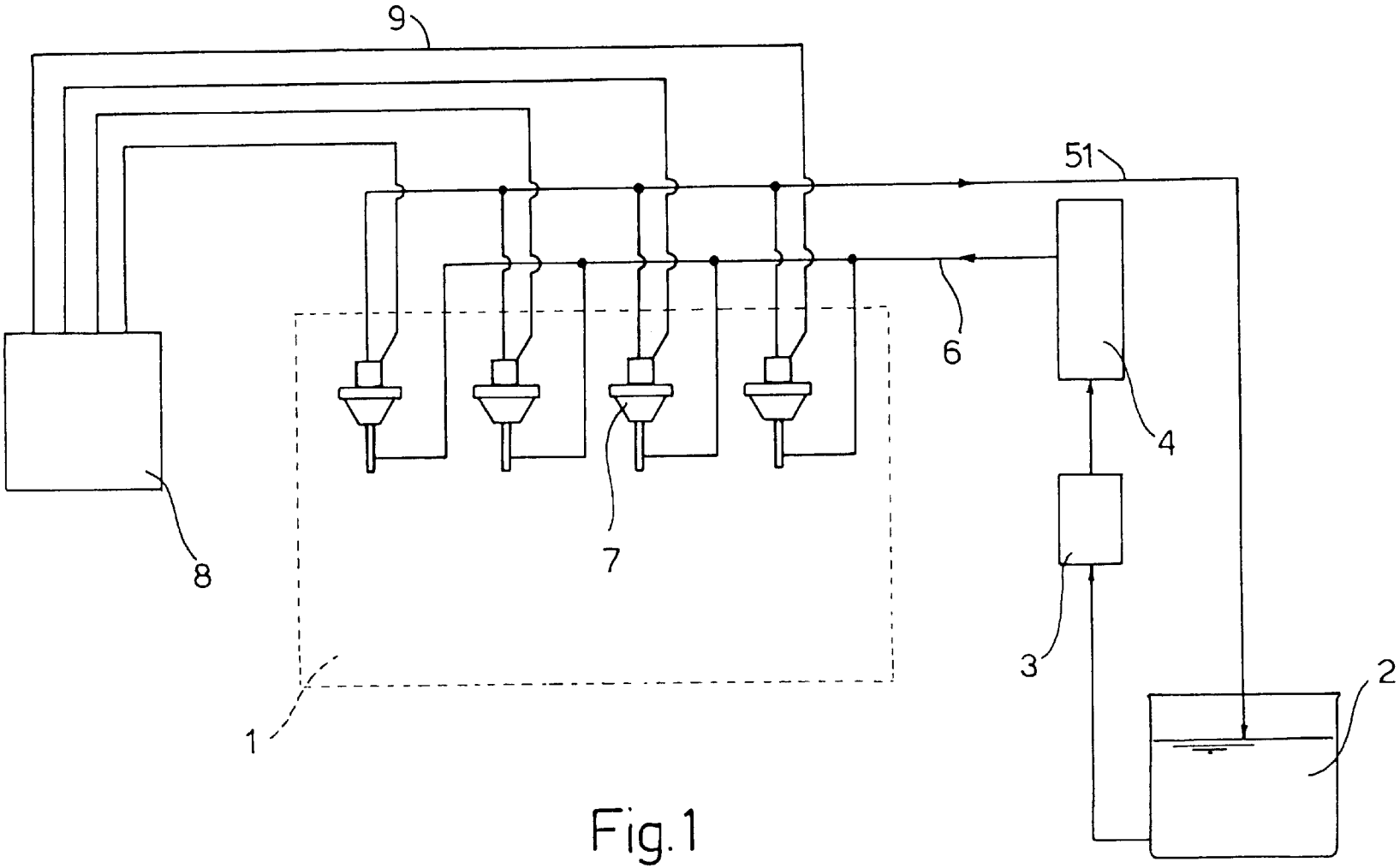
FIG. 1 shows an internal combustion engine fuel feed device featuring a group of injectors in accordance with the invention.

Number 1 in FIG. 1 indicates as a whole a four-cylinder, internal combustion, e.g. diesel, engine with a so-called common-rail injection system.

In a common-rail injection system, the fuel in a tank 2 is brought by a pump 3 to a predetermined pressure normally ranging between 200 and 1,500 bar, depending on the load conditions required of the engine; and the pressurized fuel is fed to a common pressurized-fuel vessel or common rail 4 communicating, via a conduit 6, with four injectors 7, each for injecting the pressurized fuel into a corresponding cylinder of engine 1.

Injectors 7 are controlled by an electronic control unit 8, which is supplied by sensors with information relative to engine speed and the position of the accelerator and other components of engine 1, and controls, over electric wires 9, the instant each injector 7 is activated, the duration of the respective injection, and therefore the amount of fuel injected.

As is known, each type of internal combustion engine has a particular power curve, which, on the basis of engine speed, determines maximum power output and therefore the corresponding amount of fuel to be injected by each injector 7. The power curve also defines the maximum fuel flow of engine 1, and therefore also the maximum flow for each operation of each injector 7.

Figure 2:
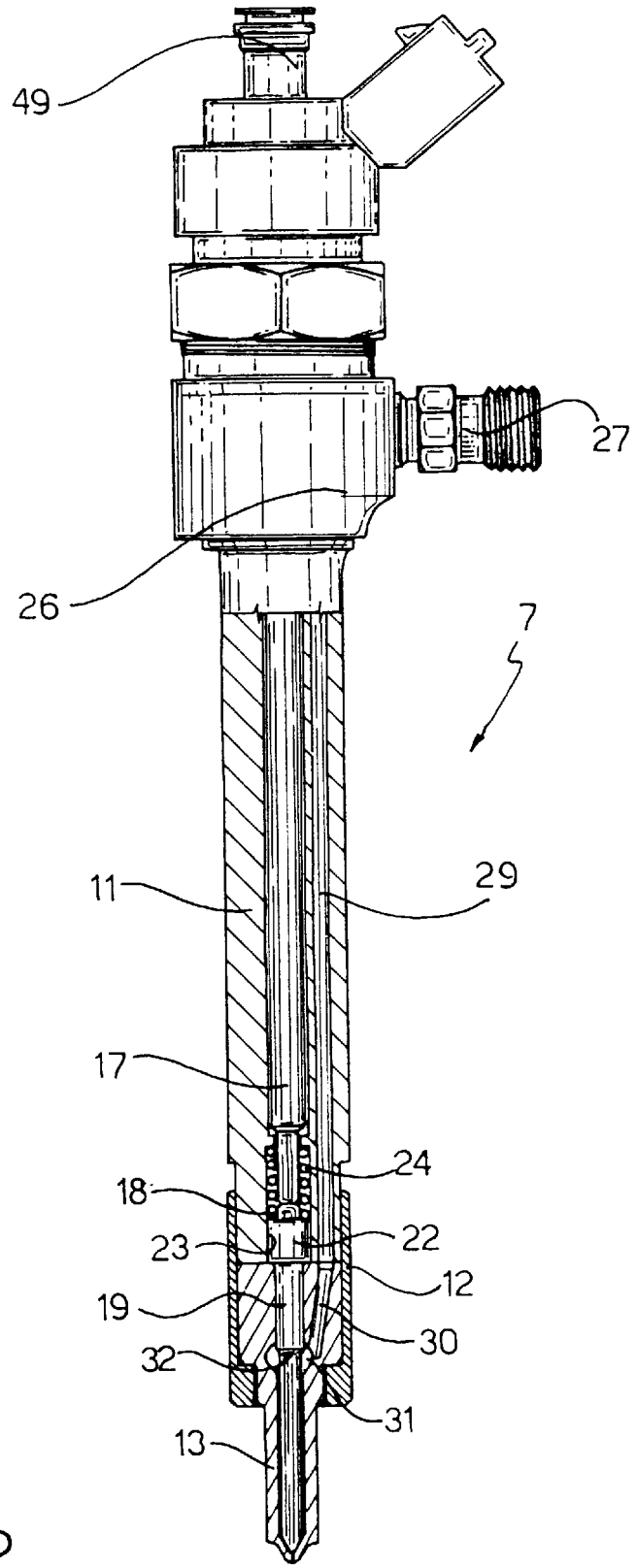
FIG. 2 shows a partly sectioned view of a fuel injector in accordance with the invention.
Figure 4:
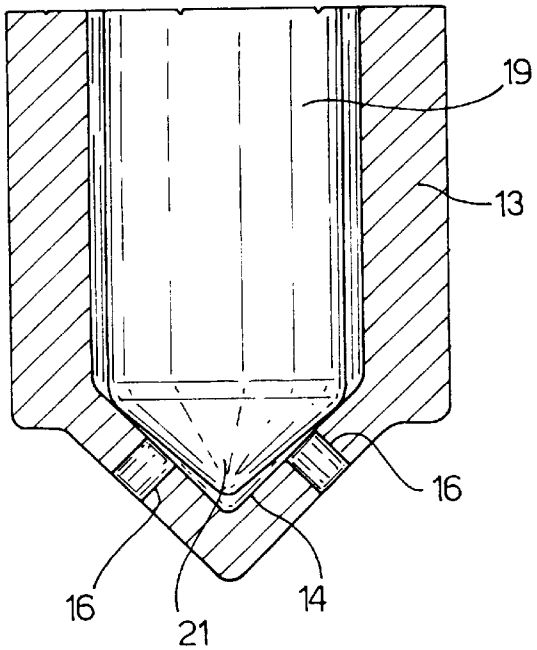
FIG. 4 shows a greatly enlarged detail of FIG. 2.

Each injector 7 (FIG. 2) comprises a hollow body 11 connected by a ring nut 12 to a nozzle 13 terminating with a conical seat 14 (see also FIG. 4) having injection orifices 16; and a control rod 17 slides inside body 11 to engage an appendix 18 of a pin 19 for closing orifices 16. More specifically, pin 19 has a conical end 21 for engaging conical seat 14 of nozzle 13, and comprises a collar 22 guided inside a cylindrical seat 23 in body 11 and normally pushed by a spring 24, which aids in closing orifice 16.

Hollow body 11 also has an appendix 26 in which is inserted an intake fitting 27 connected to pressurized; fuel supply conduit 6 (see also FIG. 1). Appendix 26 (FIGS. 2 and 3) has a hole 28, which, via a feed conduit 29 in body 11 and a feed conduit 30 in nozzle 13, communicates with an annular injection chamber 31 in nozzle 13.

Pin 19 has a shoulder 32 on which the pressurized fuel in chamber 31 acts. With respect to the inner wall 33 of nozzle 13, pin 19 has a given clearance to ensure fast fuel flow from chamber 31 to orifices 16 of nozzle 13. In known injectors, the volume of chamber 31 is normally less than the maximum amount of fuel to be injected by injector 7, so that feed conduits 29 and 30 are sized to also permit fuel supply to chamber 31 during injection.

Injector 7 also comprises a metering valve indicated as a whole by 34 (FIG. 3) and which is activated by an electromagnet 36 controlling an armature 37. Armature 37 comprises a disk 38 having slits 39 and connected to a stem 40, which is pushed downwards by a compression spring 41 housed in a central hole 42 in electromagnet 36.

Metering valve 34 comprises a body 43 having a flange 44 normally held resting on a shoulder of body 11 of injector 7 by a ring nut 46 and by means of a flange 45 of a guide 50 for guiding stem 40. Flange 45 has holes 47 communicating with a discharge chamber 48 of metering valve 34; and, via slits 39 in disk 38 and central hole 42, discharge chamber 48 communicates with a discharge fitting 49 connected to tank 2 by a common conduit 51 (FIG. 1).

Body 43 of metering valve 34 has an axial control chamber 52 (see also FIG. 5) communicating with a guide cylinder 53 in body 43 of valve 34. A piston-shaped portion 54 of rod 17 slides in fluidtight manner inside cylinder 53, which terminates with an end wall 55 adjacent to an end surface 56 of portion 54.

Body 43 comprises a calibrated radial fuel intake conduit 57 communicating with hole 28 in appendix 26 via an annular groove 58; and a calibrated axial discharge conduit 59 for discharging the fuel from control chamber 52 and communicating with discharge chamber 48.

The pressurized fuel in control chamber 52 acts on end surface 56 of portion 54 of rod 17; and, since surface 56 of rod 17 has a greater area than shoulder 32 (see also FIGS. 2 and 4), the fuel pressure, with the aid of spring 24, normally keeps rod 17 in the lowered position with end 21 of pin 19 contacting conical seat 14 of nozzle 13 to close injection orifices 16.

Discharge conduit 59 of control chamber 52 (FIGS. 3 and 5) is normally closed by a plug in the form of a ball 61, which rests on a contact surface of a conical surface 62 of flange 44, at which discharge conduit 59 terminates. Ball 61 is engaged by a guide plate 63 on which stem 40 of armature 37 acts.

When electromagnet 36 is energized, armature 37 moves stem 40 in opposition to spring 41; and the fuel pressure in control chamber 52 releases ball 61 to discharge the fuel from chamber 52 into discharge chamber 48 and fitting 49 and back into tank 2. The fuel pressure in injection chamber 31 (see also FIG. 2) in turn overcomes the residual pressure on end surface 56 of rod 17, which rises together with pin 19 to inject the fuel in chamber 31 through orifices 16.

When electromagnet 36 is deenergized, spring 41 clicks down stem 40 together with armature 37. Stem 40 also restores ball 61 to the closed position closing discharge conduit 59, and the pressurized fuel restores the pressure in control chamber 52, so that rod 17 moves back down together with pin 19 to close orifices 16.

Metering valve 34 therefore moves rod 17 together with pin 19 through an opening stroke and a closing stroke to respectively open and close nozzle 13. From the start of the opening stroke to the end of the closing stroke of rod 17 and pin 19, a given amount of fuel is injected through orifices 16, depending on how long electromagnet 36 is energized.

In known injectors, when electromagnet 36 is energized, the pressurized fuel in control chamber 52 is discharged immediately along discharge conduit 59, intake conduit 57 fails to restore the pressure in chamber 52, and almost all the fuel in injection chamber 31 is injected immediately through orifices 16.

If t0 (FIG. 6) is the instant at which electromagnet 36 is energized, injection commences at instant t1 with a predetermined delay or offset t1−t0 with respect to instant t0. The speed of the opening stroke of rod 17 (see also FIGS. 4 and 5) depends mainly on the ratio between the diameters of intake conduit 57 and discharge conduit 59.

Rod 17 is arrested at instant t2, when end surface 56 of portion 54 is arrested, dynamically balanced, a given distance from end wall 55 of guide cylinder 53. Dynamic balance is achieved when the pressure of the fuel volume compressed between end wall 55 and end surface 56 is such that the force acting on end surface 56 substantially equals the force acting on pin 19 and generated by the pressure of the fuel in common rail 4.

This position of rod 17 substantially corresponds to end 21 of pin 19 fully opening orifices 16. In fact, the length of time electromagnet 36 is energized is normally greater than time interval t2−t0.

Figure 6:
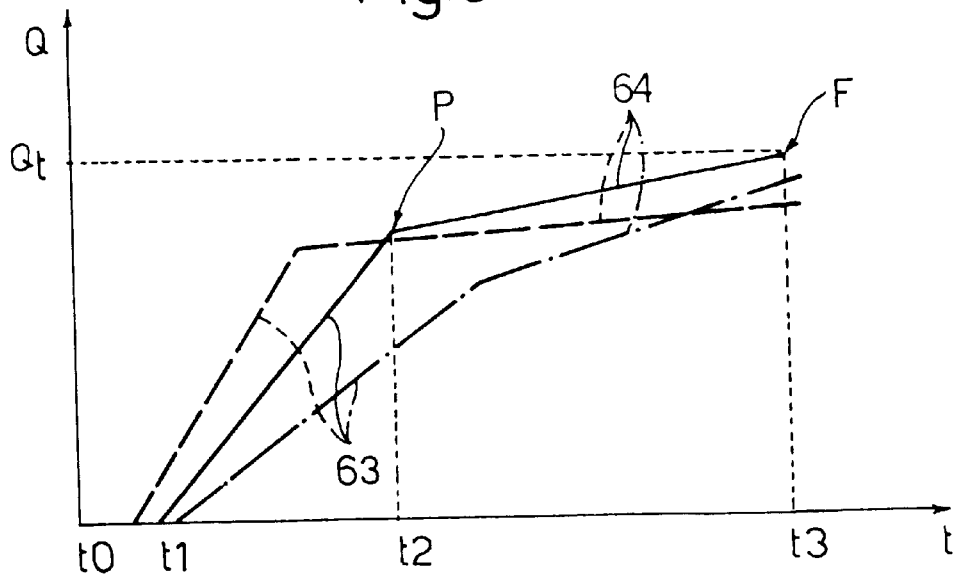
FIG. 6 shows a performance graph of known injectors.

Accordingly, when electromagnet 36 is energized from instant t1 to instant t2, the amount of fuel Q injected increases substantially steadily as shown by a first graph segment 63 indicated by the continuous line in FIG. 6, and which is straight and slopes at a given angle with respect to the x axis. If electromagnet 36 is energized beyond instant t2, the increase in the amount of fuel Q injected decreases, as shown by another less steeply inclined graph segment 64, to form a knee P at the instant t2 corresponding to maximum lift of rod 17.

Segment 64 extends up to a point F, which defines the total amount of fuel Qt injected and corresponds to electromagnet 36 being energized up to an instant t3 and then deenergized to close metering valve 34. Instant t3 varies as a function of the engine power curve fuel requirement up to a maximum, which therefore defines the maximum fuel requirement of the engine.

Due to component machining tolerances, segment 63 may vary from one injector 7 to another both as regards offset t1–t0 and slope; and instant t2 and the slope of segment 64 may also vary within certain limits. In FIG. 6, the dash lines indicate segments 63 and 64 of a second injector 7, and the dash-and-dot lines segments 63 and 64 of a third injector 7.

The total amount of fuel Qt injected for a given excitation time of electromagnet 36 may therefore vary widely for various reasons, so that classifying injectors 7 on the basis of tests at predetermined instants during injection is extremely unreliable, also because some of said predetermined instants may fall within interval t2–t1, and others within interval t3–t2.

According to the invention, injector 7 is so sized that rod 17 moves from the closed position closing nozzle 13 (FIGS. 3–5) to a maximum-travel position when electromagnet 36 is energized for a time interval up to an instant tmax. The corresponding amount of fuel injected as a result of maximum travel of rod 17 must be greater than the maximum amount of fuel Qmax (FIG. 7) required in the power curve of engine 1.

More specifically, the length, i.e. maximum lift, of rod 17 is so sized that the maximum amount of fuel Qmax required by engine 1 can be injected prior to hydraulic arrest, with surface 56 a given distance from end wall 55 of guide cylinder 53. In other words, if rod 17 is arrested hydraulically, this is done with a maximum lift of rod 17, such that the maximum amount of fuel Qmax required by engine 1 can be injected by lifting rod 17 by less than the maximum lift permitted by the geometric dimensions of guide cylinder 53.

Figure 3:
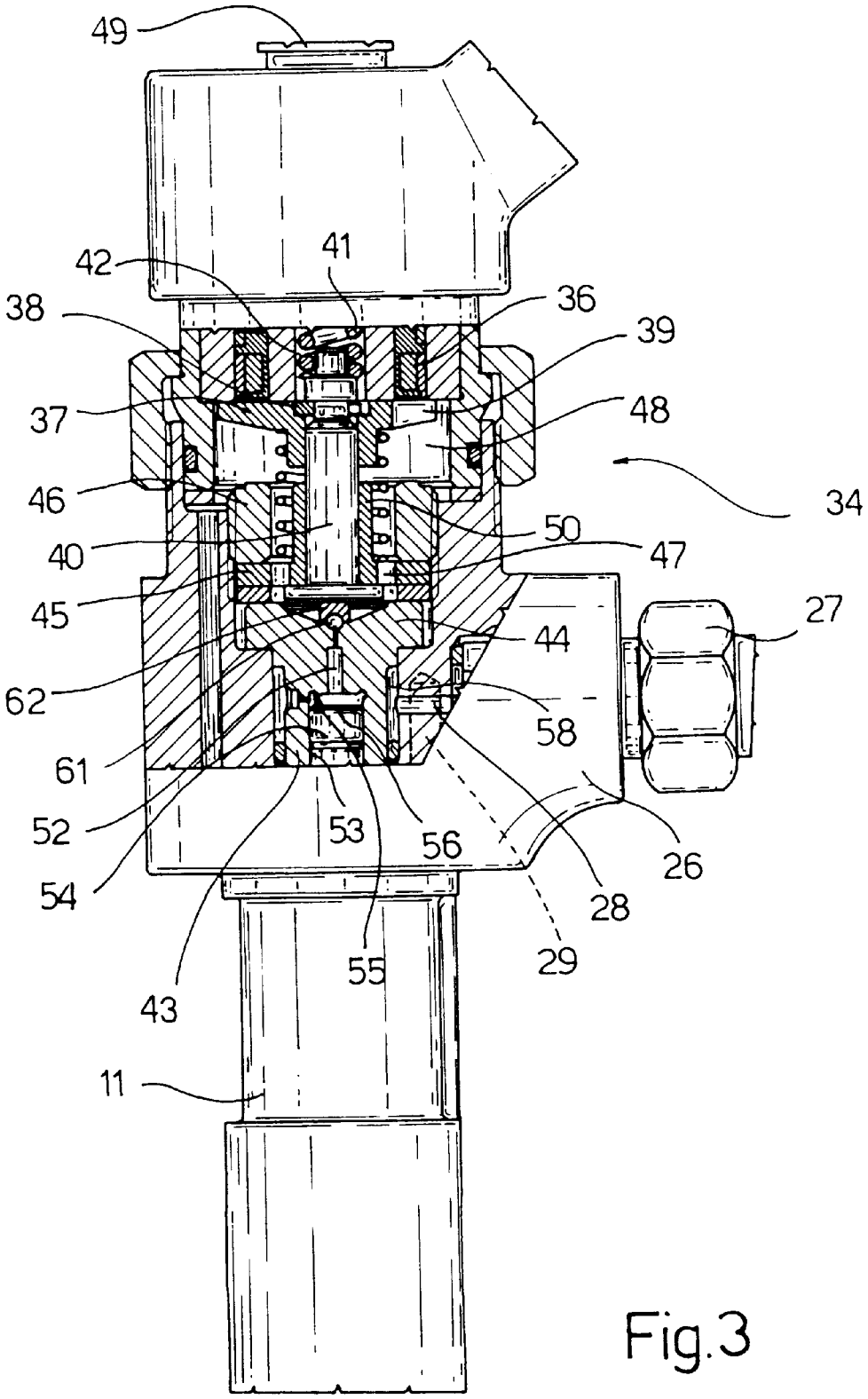
FIG. 3 shows a partly sectioned, larger-scale view of part of FIG. 2.
Figure 5:
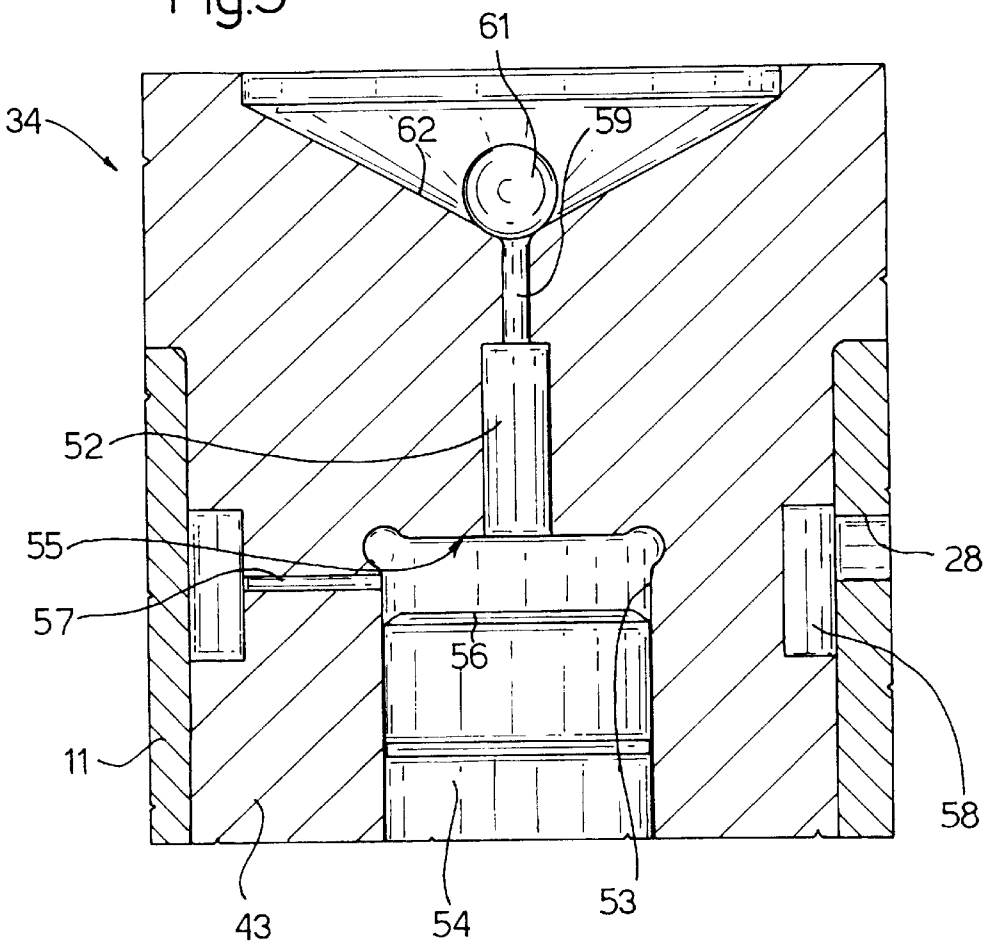
FIG. 5 shows a greatly enlarged detail of FIG. 3.

More specifically, the amount of fuel that can be injected with a maximum lift of rod 17 is at least 5% greater than the maximum amount of fuel Qmax required by engine 1. In the case of FIGS. 3 and 5, the maximum lift of rod 17, i.e. the distance between surface 56 of portion 54 and end wall 55 of guide cylinder 53, may be roughly 0.3 to 0.5 mm for engines with up to 0.65 liters/cylinder displacement, and 0.4 to 1 mm for higher unit displacement engines.

Tests by the Applicant, in fact, have shown that increasing lift by at least 10% (i.e. adding to the 5% a given percentage due to process spread) is sufficient to ensure knee P of the injector characteristic falls outside the normal operating range of the injector. In other words, the increased lift of rod 17 ensures that, for injected fuel quantities typically within interval 0–(Qmax+10%), all the injectors perform consistently.

Moreover, control chamber 52 (FIG. 5) and intake and discharge conduits 57 and 59 are so sized as to permit maximum travel of rod 17 within a time interval not exceeding 5% of the maximum length of time t3–t0 electromagnet 36 is energized.

The amount of fuel Q injected by injector 7 according to the invention as a function of time t is shown by a sloping graph segment 66 (FIG. 7) which starts at instant t1 and rises steadily up to instant t3, whereas the required maximum-travel time tmax–t1 of rod 17 is always greater than time t3–t1, so that knee P and the second graph segment are always outside the operating range of injector 7. The dash and dash-and-dot lines in the FIG. 7 graph refer to a second and third injector 7.

Figure 7:
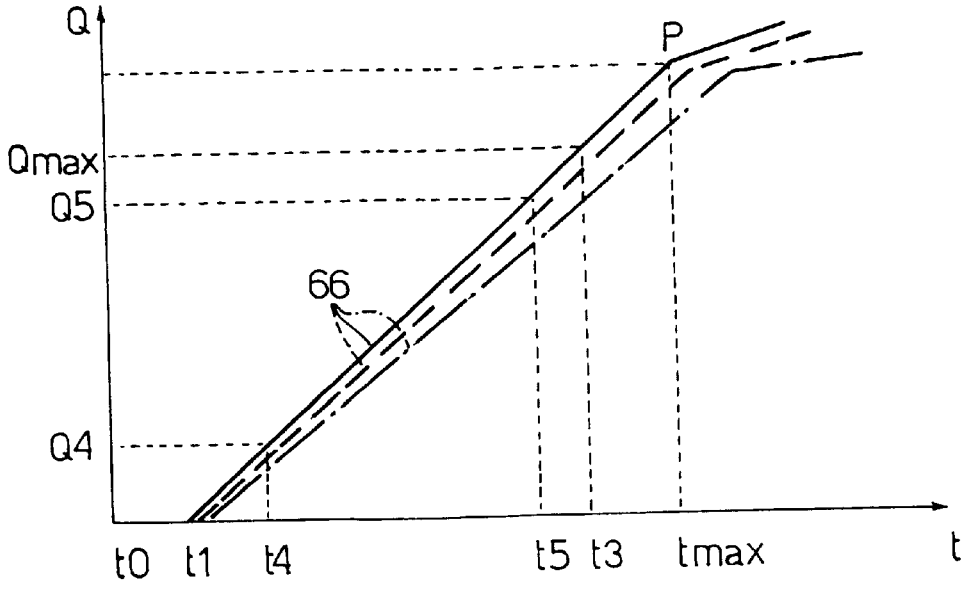
FIG. 7 shows a performance graph of the injectors according to the invention.

As shown in FIGS. 6 and 7, by increasing the lift of rod 17 by at least 5%, characteristics 66 of injectors 7 do not cross over within the operating range, thus permitting fast, accurate classification of injectors 7 as a function of offset and characteristics of the slope.

To classify mass produced injectors 7, in fact, it is now possible to test each injector at two instants t4 and t5 following excitation instant t0 and lying along relative straight graph segment 66 (FIG. 7). Instants t4 and t5 define two corresponding positions or lifts of rod 17 together with pin 19, and the two corresponding fuel amounts Q4 and Q5 so tested provide for unequivocally defining both injection start offset t1–t0 and the slope of segment 66 or increase in the amount of fuel injected between t4 and t5, and therefore the performance of injector 7 over the entire operating range.

A given engine 1 (FIG. 1) is therefore fitted with injectors 7 in the same class. The data relative to offset and the increase in the amount of fuel injected (i.e. the slope of graph segment 66) may be memorized in control unit 8, which will take this and other data into account in defining the length of time the assembled injectors 7 are energized.

The method of classifying and selecting injectors 7 according to the invention therefore comprises the steps of:

preparing a series of injectors 7 with corresponding rods 17; each of said rods 17 being movable from a closed position and through an opening stroke to a position corresponding to a maximum travel, so that the amount of fuel injected, between the start of said opening stroke into said position corresponding to said maximum travel, and the end of the respective closing stroke, is greater than a maximum amount of fuel required by said power curve;

testing the amount of fuel injected by each of said injectors 7, by moving the corresponding rod 17 into two positions at distances, from said closed position, smaller than said maximum travel, so as to define the delay t1–t0 in the start of injection and the increase Q5–Q4 in the amount of fuel injected;

selecting for a given engine 1 a group of injectors 7 having a given delay and a given increase in the amount of fuel injected; and memorizing, at assembly to engine 1, said given delay t1–t0 and said given increase Q5–Q4 in a memory of a control unit 8 for controlling injectors 7.

The advantages, with respect to known technology, of injector 7 according to the invention will be clear from the foregoing description. In particular, fuel is only injected during the travel of rod 17, so that the performance of injector 7 can be established perfectly by simply testing it at two strokes of rod 17. Moreover, classification of injectors 7 is simpler and more efficient.

Clearly, changes may be made to the injector as described herein without, however, departing from the scope of the accompanying Claims. For example, intake conduit 57 may be located at control chamber 52 as opposed to cylinder 53.

What is claimed is:

1. A fuel injector for an internal combustion engine having a predetermined power curve, the injector comprising a nozzle normally closed by a rod; said rod being movable between a closed position closing a nozzle orifice and an open position opening said nozzle orifice, through an opening stroke and a closing stroke, by the fuel pressure in a control chamber; said control chamber having an intake conduit and a discharge conduit; a metering valve comprising a plug for said discharge conduit and being adapted to be energized by an electromagnet for a variable length of time corresponding to the amount of fuel for injection;

wherein said rod is moved from said closed position to a position corresponding to a maximum travel distance of the rod, when said metering valve is energized for a maximum time interval, and wherein the amount of fuel injected from the beginning of said opening stroke to the end of the respective closing stroke corresponding to said maximum travel distance of the rod is greater than a maximum amount of fuel required by said predetermined power curve.

2. The injector as claimed in claim 1, wherein said intake conduit and said discharge conduit are so sized as to arrest said rod hydraulically after said maximum travel distance; said maximum amount of fuel being injectable with a travel of said rod smaller than that relative to said hydraulic arrest.

3. The injector as claimed in claim 1, wherein said amount of fuel injected following said maximum travel exceeds said maximum amount of fuel by at least 5%, plus a given percentage due to process spread.

4. The injector as claimed in claim 1, wherein said rod slides inside a cylindrical guide in a hollow body supporting said nozzle; an injection chamber communicating with said nozzle and with a pressurized-fuel feed conduit; characterized in that the volume of said injection chamber and the minimum section of said feed conduit are so sized that fuel flow increases linearly while said electromagnet is energized.

5. The injector as claimed in claim 1, wherein said control chamber and said intake and discharge conduits are so sized as to enable said rod to effect said maximum travel in a time not exceeding 5% of the maximum length of time said electromagnet is energized.

6. A method of classifying and selecting a series of fuel injectors for an internal combustion engine having a predetermined power curve, wherein each injector comprises a nozzle normally closed by a rod, said rod being movable between a closed position closing said nozzle and an opening position opening said nozzle through an opening stroke and a closing stroke, by the fuel pressure in a control chamber; the method comprising the steps of:

preparing a plurality of injectors with corresponding rods, each of said rods being movable from said closed position, through an opening stroke, to a position corresponding to a maximum travel, wherein the amount of fuel injected, between the beginning of said opening stroke into said position corresponding to said maximum travel and the end of the respective closing stroke, is greater than a maximum amount of fuel required by said predetermined power curve;

testing the amount of fuel injected by each injector by moving the corresponding rod to two different positions that are away from said closed position and closer than said maximum travel position of the rod, so as to define the delay in the start of injection and the increase in the amount of fuel injected; and selecting for a given engine a group of injectors having a given delay and a given increase in the amount of fuel injected.

7. The method as claimed in claim 6 further comprising memorizing, at assembly to said engine, said given delay and said given increase in a memory of a control unit for controlling said group of injectors.

8. A fuel injector for an internal combustion engine having a predetermined power curve, comprising:

a nozzle normally being in a closed position;

a rod member being movable between a first position closing a nozzle orifice and a second position opening said nozzle orifice through an opening stroke and a closing stroke, respectively;

a control chamber having a discharge conduit; and a metering valve comprising a plug member for closing said discharge conduit, said metering valve being adapted to be activated for a variable length of time to allow a corresponding amount of fuel for injection;

wherein the amount of fuel injected from the beginning of an opening stroke to the end of a respective closing stroke when the rod member moves to a maximum travel distance is greater than a maximum amount of fuel required by said predetermined power curve.

* * * * *

UNITED STATES PATENT AND TRADEMARK OFFICE

CERTIFICATE OF CORRECTION

PATENT NO. : 6,539,924 B2
DATED : April 1, 2003
INVENTOR(S) : Mario Ricco

It is certified that error appears in the above-identified patent and that said Letters Patent is hereby corrected as shown below:

Title page,
Item [73], Assignee, change "C.F.R." to -- C.R.F. --.

Item [30], Foreign Application Priority Data, change "TO20A0267" to --TO2000A0267 --.

Signed and Sealed this

Eighteenth Day of May, 2004

JON W. DUDAS
*Acting Director of the United States Patent and Trademark Office*